US010267220B2

(12) United States Patent
Hilt et al.

(10) Patent No.: US 10,267,220 B2
(45) Date of Patent: Apr. 23, 2019

(54) PORTABLE WORK APPARATUS

(71) Applicant: Andreas Stihl AG & Co. KG, Waiblingen (DE)

(72) Inventors: Thomas Hilt, Winnenden (DE); Klaus Prach, Weinstadt (DE); Thomas Stark, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 291 days.

(21) Appl. No.: 15/208,359

(22) Filed: Jul. 12, 2016

(65) Prior Publication Data

US 2017/0016450 A1 Jan. 19, 2017

(30) Foreign Application Priority Data

Jul. 18, 2015 (DE) ..... 10 2015 009 410

(51) Int. Cl.

| | |
|---|---|
| ***F04D 29/40*** | (2006.01) |
| ***F02B 63/06*** | (2006.01) |
| ***F02B 63/02*** | (2006.01) |
| *F02B 75/02* | (2006.01) |

(52) U.S. Cl.

CPC ..... *F02B 63/06* (2013.01); *F02B 63/02* (2013.01); *F04D 29/403* (2013.01); *F02B 2075/025* (2013.01); *F05B 2240/12* (2013.01)

(58) Field of Classification Search

CPC .... F02B 63/02; F02B 63/06; F02B 2075/025; A47L 5/14; F04D 25/02; F05B 2240/12; F05B 2240/30

USPC ..... 123/198 E

See application file for complete search history.

(56) References Cited

U.S. PATENT DOCUMENTS

| | | | | |
|---|---|---|---|---|
| 4,913,112 | A * | 4/1990 | Iida | F02B 63/02 123/195 R |
| 4,993,865 | A | 2/1991 | Nagashima | |
| 5,806,133 | A * | 9/1998 | Iida | A47L 5/24 15/405 |
| 6,470,848 | B2 * | 10/2002 | Takahashi | F02B 63/02 123/198 E |
| 7,063,050 | B2 * | 6/2006 | Watanabe | B08B 5/02 123/198 E |
| 2001/0047993 | A1 | 12/2001 | Takahashi et al. | |

* cited by examiner

*Primary Examiner* — Nathan C Zollinger
(74) *Attorney, Agent, or Firm* — Walter Ottesen, P.A.

(57) ABSTRACT

A portable work apparatus has a drive motor and a housing which is formed at least partially by a housing part. The work apparatus has an operating fluid tank which is formed separately from the housing part and which has a cavity for receiving operating fluid. The operating fluid tank has a first portion which is arranged in a receptacle of the housing part, and a second portion which at least partially delimits the cavity and which protrudes from the receptacle. Provision is made for the operating fluid tank to be fixed to the housing part by at least one fastener, and for the receptacle to be delimited at least partially by a plurality of ribs of the housing part that are arranged at a spacing (f) from one another.

15 Claims, 4 Drawing Sheets

PORTABLE WORK APPARATUS

CROSS REFERENCE TO RELATED APPLICATION

This application claims priority of German patent application no. 10 2015 009 410.6, filed Jul. 18, 2015, the entire content of which is incorporated herein by reference.

BACKGROUND OF THE INVENTION

U.S. Pat. No. 4,993,865 discloses a motor-driven saw which has an operating fluid tank. The operating fluid tank is arranged in a receptacle of the housing and projects beyond the receptacle by way of its filler neck. With such an arrangement of the fuel tank, the tank can be damaged in the event of an impact with the tank filler neck, for example when the motor-driven saw falls.

United States patent application publication 2001/0047993 A1 discloses a handheld blower apparatus, the fuel tank of which is mounted in the housing via damping elements in order to prevent the transmission of vibrations to the fuel tank. Mechanical protection of the fuel tank is also achieved via the damping elements. However, the damping elements are relatively large and as a result increase the overall size of the work apparatus.

SUMMARY OF THE INVENTION

It is an object of the invention to provide a portable work apparatus, which has a simple structure and in which damage to the operating fluid tank is reliably avoided with the forces that occur during normal operation.

Provision is made for the operating fluid tank to be secured to the housing part by at least one fastener. Via the at least one fastener, forces introduced at the operating fluid tank can be dissipated into the housing part. The operating fluid tank is arranged in a receptacle of the housing part. The receptacle is delimited at least partially by a plurality of spaced-apart ribs of the housing part. Forces that act on the operating fluid tank can likewise be absorbed via the ribs, such that overloading of the fastener is easily avoided. At the same time, a stress concentration at the operating fluid tank and resultant overloading of the operating fluid tank is avoided. The operating fluid tank is advantageously secured in position via the at least one fastener, and the ribs serve merely to additionally support the operating fluid tank under the action of large forces. The fact that the receptacle is delimited by spaced-apart ribs rather than by a continuous wall results in flexibility of the receptacle. If large forces act on the operating fluid tank, the operating fluid tank can yield in the direction of the ribs, and the ribs preferably flex elastically. It has been shown that, as a result of the dissipation of the forces both via the at least one fastener and via the spaced-apart ribs, excessive loading of the operating fluid tank can be largely avoided. Excessive loading of the at least one fastener is avoided, too. Even if relatively large forces act on the operating fluid tank, for example if the operating fluid tank falls on the second portion protruding from the receptacle, or an impact acts on the operating fluid tank in this region, damage to the operating fluid tank can be avoided.

Advantageously, the second portion includes a filler neck of the operating fluid tank. Since the second portion protruding from the receptacle includes the filler neck, the filler neck is easily accessible from the outside. However, there is a risk that high forces will act on the filler neck during operation. These forces can be absorbed via the ribs delimiting the receptacle. In order to achieve sufficiently soft support of the operating fluid tank, provision is advantageously made for the total width, measured in the circumferential direction, of the ribs to be less than 50% of the circumferential range of the operating fluid tank in the region of the ribs. The width of the ribs is in this case measured on that side of the ribs that is arranged next to the operating fluid tank. Accordingly, the operating fluid tank is supported on the ribs over less than 50% of its circumferential range in the region of the ribs. Preferably, the total width, measured in the circumferential direction, of the ribs is less than 30% of the circumferential range of the operating fluid tank in the region of the ribs. The circumferential range of the operating fluid tank in the region of the ribs is in this case that part of the circumference of the operating fluid tank that is not supported on a wall of the housing of the work apparatus. Provision can be made for the circumferential range of the operating fluid tank in the region of the ribs to extend around the entire circumference of the operating fluid tank. Preferably, the region of the ribs extends only over a part of the circumference of the operating fluid tank, however.

With the fastener released, the operating fluid tank is advantageously removable from the receptacle in a removing direction. The receptacle advantageously has a base. The ribs extend advantageously parallel to the removing direction. The ribs extend in particular from the base of the receptacle in the removing direction, such that the forces absorbed by the ribs can be dissipated into the base of the receptacle. Advantageously, the ribs are located close to the circumference of the operating fluid tank. Preferably at least one rib is at a spacing, measured perpendicularly to the removing direction, of 0.1 mm to 5 mm from the operating fluid tank. The spacing is in this case advantageously measured in a plane which is perpendicular to the removing direction. The spacing is advantageously measured perpendicularly to the outer wall of the operating fluid tank. Preferably, all of the ribs have a spacing, measured perpendicularly to the removing direction, of 0.1 mm to 5 mm.

The at least one fastener advantageously fixes the operating fluid tank in a play-free manner in the removing direction. As a result, a movement of the operating fluid tank is only possible by corresponding elastic deformation of the components that form the receptacle and/or of the at least one fastener and/or of the components that interact with the at least one fastener.

Advantageously, at least one rib has a delimiting region that faces the operating fluid tank and delimits the receptacle, and also a supporting region directed transversely thereto and away from the receptacle. The forces exerted on the rib by the operating fluid tank are advantageously absorbed by the delimiting region and dissipated via the supporting region. The fact that the supporting region extends transversely to the delimiting region results in high stability of the ribs at a very small material thickness, with the result that the overall weight of the work apparatus can be kept relatively low. By coordinating the dimensions of the delimiting region and the supporting region in a suitable manner, a desired strength and elasticity of the ribs can be set.

Advantageously, the first and the second portion of the operating fluid tank are connected together at an outwardly protruding rim or edge. As a result, the operating fluid tank can be produced easily as an injection-molded part. At the rim, the two halves of the operating fluid tank are advantageously connected together, in particular welded together, preferably by friction welding, in particular by vibration welding. However, provision can also be made for the rim to be arranged entirely in the receptacle, that is, be part of the first portion of the operating fluid tank, or for the rim to be arranged entirely outside the receptacle, that is, be part of the second portion of the operating fluid tank. A partial arrangement of the rim in the receptacle can also be advantageous.

Advantageously, the housing part has at least one wall which forms an outer wall of the work apparatus and which at least partially delimits the receptacle. Good positioning and support of the operating fluid tank is achieved when the rim bears against an end side of the outer wall. The operating fluid tank and the housing part are advantageously made of different plastics materials. As a result, the operating fluid tank can be produced from a media-resistant plastics material, while the housing part can be produced from a plastics material which primarily has high strength.

Advantageously, the work apparatus is a blower apparatus, the drive motor of which drives at least one fan wheel for delivering a stream of blowing air through a blower tube. The fan wheel advantageously delivers the stream of blowing air through a blower scroll which is delimited at least partially by the housing part configured as a blower housing. The base of the receptacle is advantageously delimited by a wall of the housing part, wherein the wall at least partially delimits the blower scroll. The wall delimiting the blower scroll is accordingly used at the same time to form the base of the receptacle. This results in a simple and compact structure.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
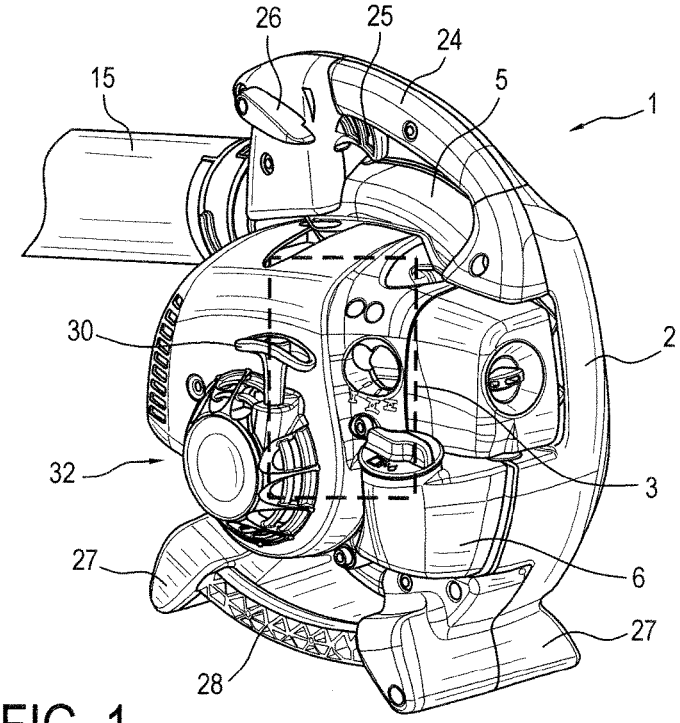
FIG. 1 shows a perspective illustration of a blower apparatus.

FIG. 1 shows a blower apparatus 1 as an embodiment of a portable work apparatus. However, the work apparatus can also be some other portable work apparatus, for example a motor-driven saw, a brushcutter, a cut-off grinder or the like. The blower apparatus 1 has a housing 32. Arranged in the housing 32 is a drive motor 3, which is configured in the embodiment as a combustion engine, preferably as a two-stroke engine. The drive motor 3 is a single cylinder engine. Secured to a top side of the housing 32 is a handle 24 for guiding the blower apparatus 1 during operation. An operating element, specifically a throttle lever 25, is pivotably mounted on the handle 24. Provided next to the handle 24 is a setting lever 26 by way of which the strength of an air stream delivered through a blower tube 15 is settable. The setting lever 26 can fix for example the position of the throttle lever 25. Provided on the housing 32, on the side remote from the handle 24, are two feet 27 on which the blower apparatus 1 can be set down. Between the feet 27, there extends a further handle 28 such that the blower apparatus 1 can also be carried with both hands. This is advantageous in particular when the blower apparatus 1 is also usable as a suction apparatus.

Figure 3:
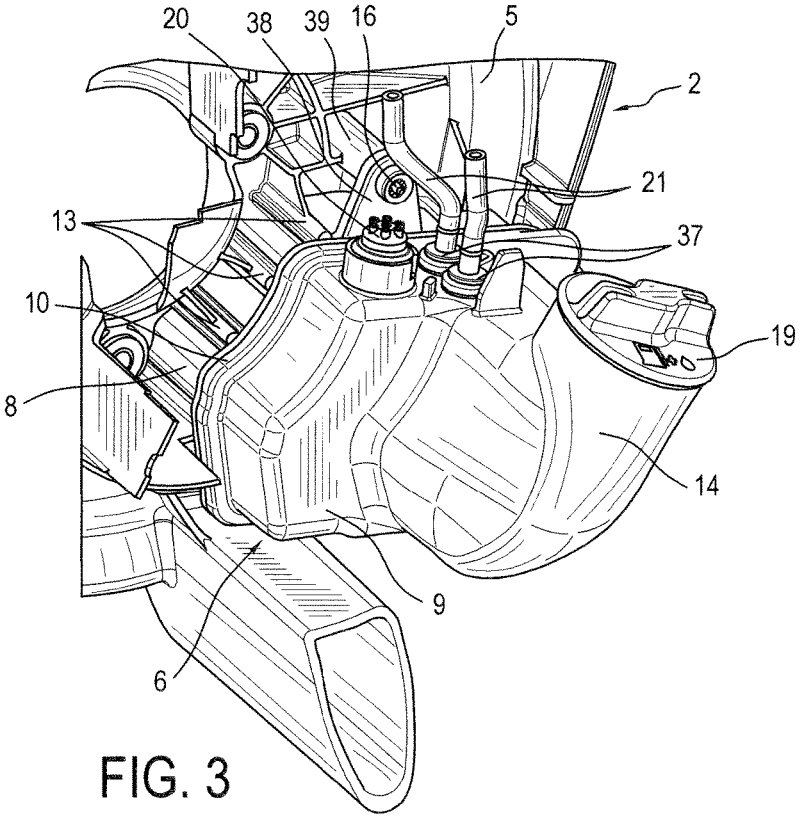
FIG. 3 shows a perspective detail illustration of the housing part with the operating fluid tank arranged in the receptacle.

A starter handle 30 of a starter device 29 schematically shown in FIG. 3 projects from the housing 32. The starter device 29 serves to start the combustion engine 3. The blower apparatus 1 furthermore has an operating fluid tank 6, in the embodiment a fuel tank, which is arranged partially in a housing part 2 of the housing 32. The operating fluid tank 6 can for example also be an oil tank or water tank.

Figure 2:
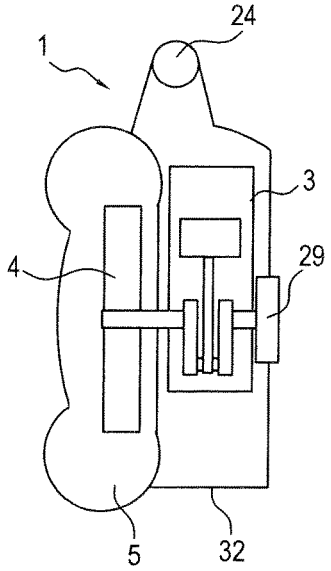
FIG. 2 shows a schematic sectional illustration through the blower apparatus from FIG. 1.

As FIG. 2 shows, the drive motor 3 drives a fan wheel 4. The fan wheel 4 is arranged in a blower scroll 5 and delivers an air flow through the blower scroll 5, the air flow flowing through a blower tube 15 secured to the housing 32. The housing part 2 delimits the blower scroll 5 on the side facing the combustion engine 3.

FIG. 3 shows the arrangement of the operating fluid tank 6 on the housing part 2 in detail. The operating fluid tank 6 has a first portion 8, which is arranged in a receptacle 11 (FIG. 4) formed in the housing part 2. The operating fluid tank 6 has a second portion 9, which protrudes from the receptacle 11. The second portion 9 of the operating fluid tank 6 is thus not protected by the housing part 2. The second portion 9 is also located outside the housing 32, as FIG. 1 shows. The second portion 9 includes a filler neck 14, to which a tank cover 19 is fastened. Arranged on the operating fluid tank 6 is a valve 20, which can serve to ventilate and/or vent the operating fluid tank 6. Arranged on the operating fluid tank 6 in the embodiment are two connection stubs 37 to which fuel lines 21 lead. The fuel lines 21 advantageously include a feed line for feeding fuel to the combustion engine 3 and a return line via which fuel can flow back into the operating fluid tank 6.

As FIG. 3 shows, the two portions 8 and 9 of the operating fluid tank 6 are connected together at an outwardly protruding rim 10. The rim 10 is likewise arranged outside the receptacle 11 and is thus part of the second portion 9. The portions 8 and 9 correspond in the embodiment to the part-shells from which the operating fluid tank 6 is produced. The part-shells can be produced for example by injection-molding and are connected firmly together at the rim 10, for example by welding, in particular by friction welding, preferably vibration welding. As FIG. 3 shows, ribs 13 which delimit the receptacle 11 are located next to the first portion 8 of the operating fluid tank 6. The ribs 13 extend close to the rim 10. The operating fluid tank 6 is fixed to the housing part 2 via two fastening screws 16, of which only one is visible in FIG. 3. The fastening screw 16 passes through a tab 38 of the operating fluid tank 6 and is screwed into a fastening dome 39 of the housing part 2. The two fastening screws 16 secure the operating fluid tank 6 to the housing part 2 in a play-free manner. Fastening with play can also be advantageous.

Figure 4:
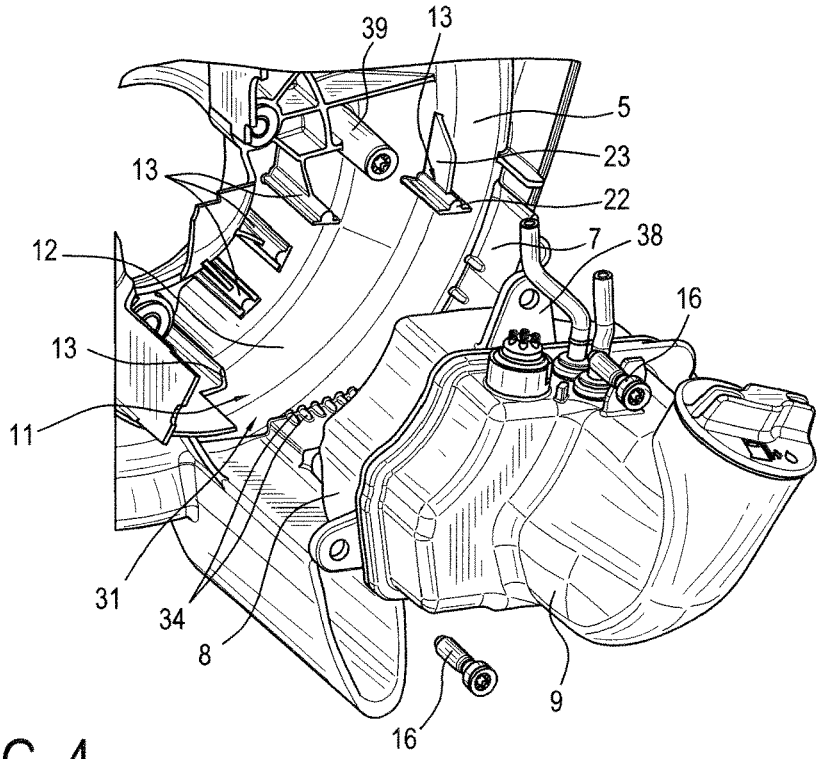
FIG. 4 shows the arrangement from FIG. 3 in an exploded illustration.
Figure 5:
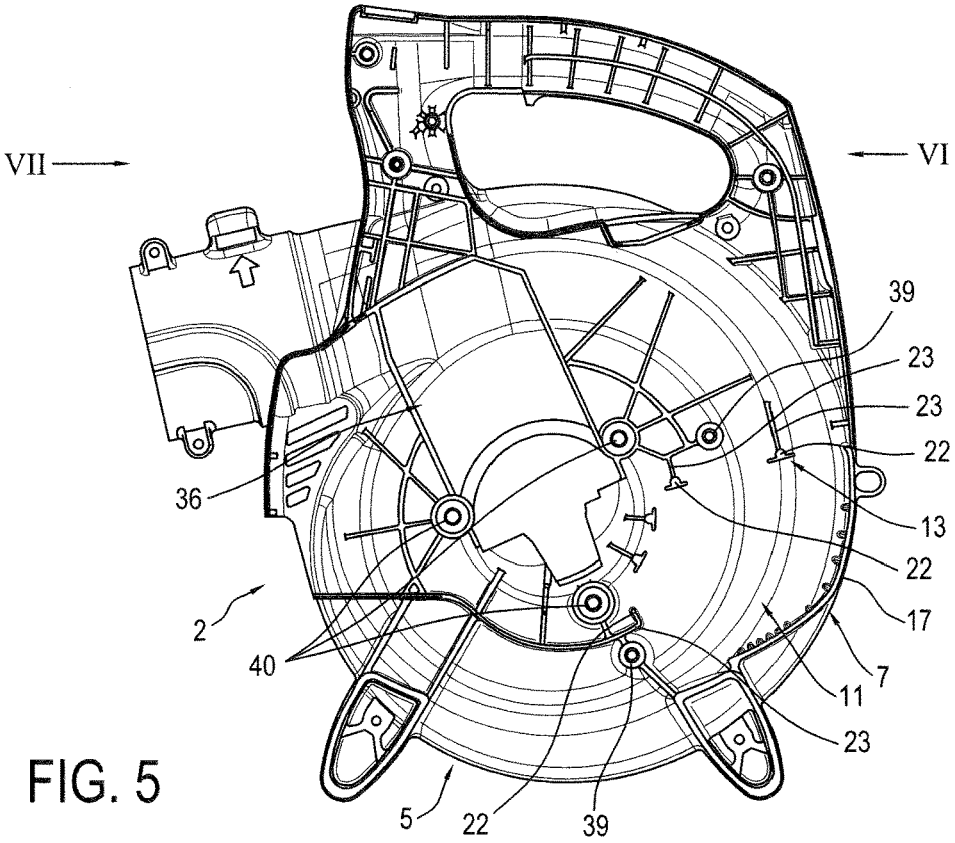
FIG. 5 shows a side view of the housing part.

As FIGS. 4 and 5 show, a total of five ribs 13 are provided in the embodiment. Each rib 13 has a delimiting region 22, which delimits the receptacle 11 and which preferably extends approximately parallel to the adjacent wall of the operating fluid tank 6 (FIG. 3). The ribs 13 each have a supporting region 23, which is directed away from the delimiting region 22 and from the receptacle 11. The supporting regions 23 can in this case transition into reinforcement ribs or housing walls of the housing part 2. In the embodiment, the delimiting regions 22 and the supporting regions 23 form an approximately T- or L-shaped cross section. This results in high stability of the ribs 13. As FIG. 4 also shows, the receptacle 11 is delimited by a base 12 which is formed on the housing part 2. The base 12 simultaneously forms a wall which delimits the blower scroll 5. The housing part 2 has an outer wall 7 which likewise delimits the receptacle 11. The outer wall 7 is a wall that outwardly delimits the housing 32. The ribs 13 extend to the base 12 of the receptacle 11. The ribs 13 are advantageously formed in one piece with the housing part 2, and in particular are integrally formed thereon. Provided in a foot region, adjoining the outer wall 7 and the base 12, of the receptacle 11 are supporting studs 34 which likewise delimit the position of the operating fluid tank 6 in the receptacle 11. As a result, the operating fluid tank 6 does not rest flat against the outer wall 7 but is arranged at a short distance from the outer wall 7.

As FIGS. 4 and 5 show, the ribs 13 are arranged on the top side, that is, the side arranged at the top in the intended working position of the blower apparatus 1, and on a side, located in the vertical direction, of the operating fluid tank 6. Advantageously, no ribs 13 are arranged on that side of the operating fluid tank 6 that is located at the bottom in the intended working position. The ribs 13 serve in particular to absorb the forces exerted by the operating fluid when the blower apparatus 1 falls. On account of the inertia of the operating fluid, these forces act primarily on the top side of the operating fluid tank 6.

As FIG. 4 shows, the operating fluid tank 6 is fixed to the housing part 2 by two fastening screws 16. As FIG. 5 shows, two fastening domes 39 for the fastening screws 16 are provided on the housing part 2. As FIG. 5 also shows, the housing part 2 forms the rear wall of the blower scroll 5. Also formed on the housing part 2 is a receptacle 36 for the drive motor 3. The drive motor 3 is fixed to the housing part 2 at fastening domes 40.

Figure 6:
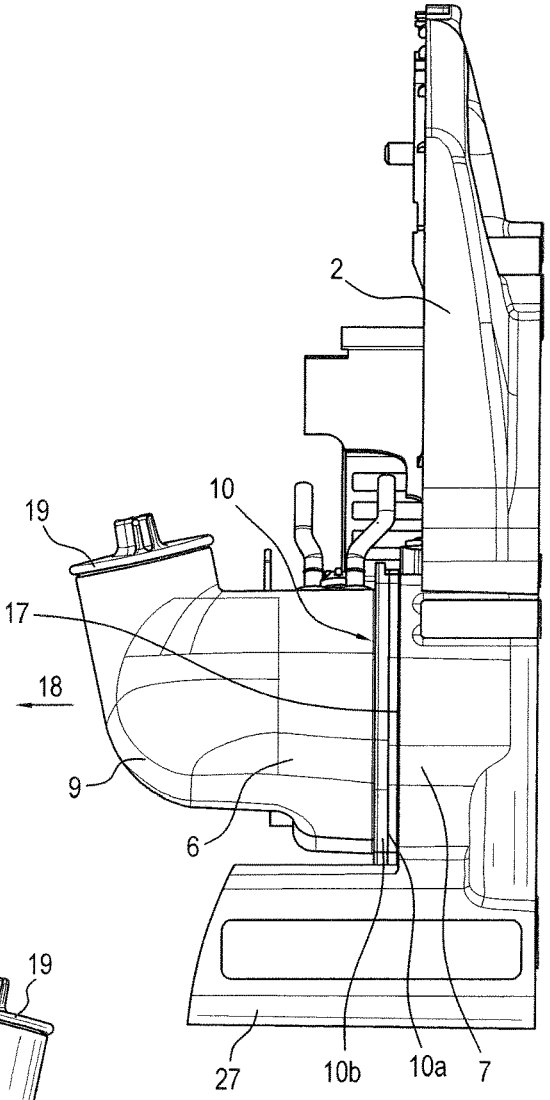
FIG. 6 shows a side view of the housing part with the operating fluid tank arranged thereon, in the direction of the arrow VI in FIG. 5.

As FIG. 5 also shows, the outer wall 7 has an end side 17. As FIG. 6 shows, the rim 10 rests against the end side 17 of the outer wall 7. In this case, the rim 10 advantageously terminates flush with the outer wall 7.

FIG. 6 shows the configuration of the rim 10 in detail. The rim 10 has a first portion 10*a* which is integrally formed on the first portion 8 (FIG. 4) of the operating fluid tank 6, and a second portion 10*b* which is integrally formed on the second portion 9. The portions 10*a* and 10*b* are in this case each formed in one piece with the portions 8 and 9. At the portions 10*a* and 10*b* of the rim 10, the two portions 8 and 9 are connected firmly together, preferably by welding, in particular by friction welding, infrared welding or hot gas welding. Connecting by way of adhesive bonding or the like can also be advantageous, however.

Figure 7:
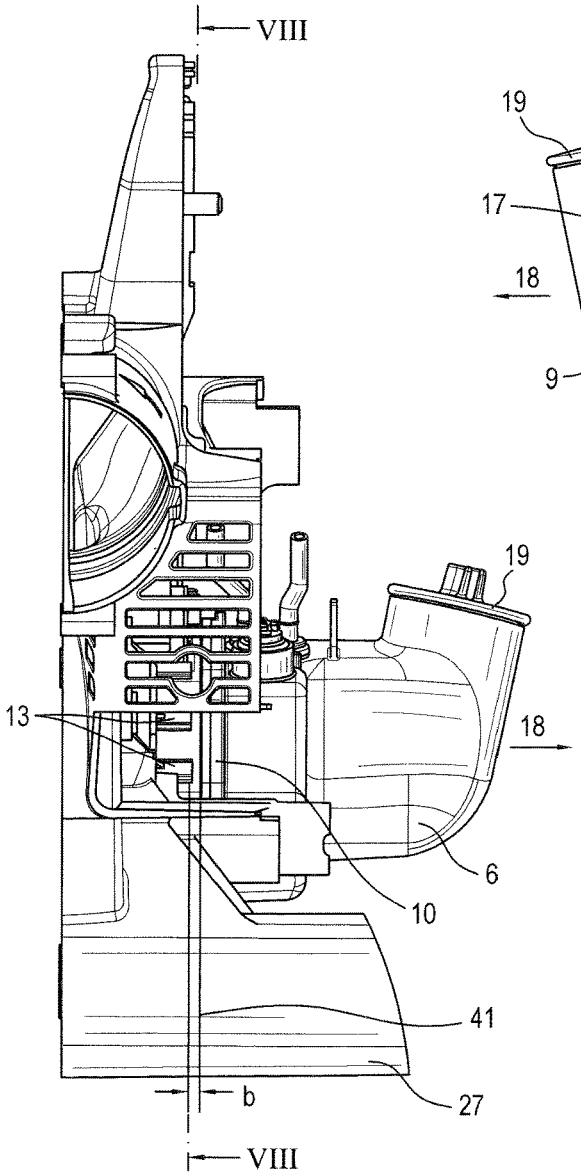
FIG. 7 shows a side view of the housing part with the operating fluid tank arranged thereon, in the direction of the arrow VII in FIG. 5.

With the fastening screws 16 released, the operating fluid tank 6 can be removed from the receptacle 11 in a removing direction 18. The rim 10 extends perpendicularly to the removing direction 18 in the embodiment. The ribs 13 extend from the base 12 parallel to the removing direction 18. As FIG. 7 shows, the ribs 13 are at a spacing (b) from the rim 10 which is advantageously in the region of a few millimeters. This ensures that the operating fluid tank 6 bears against the end side 17 of the outer wall 7 and/or against the base 12, but not on the ribs 13. As a result, tolerances can be compensated, and warping of the operating fluid tank 6 in the receptacle 11 is also avoided in an unfavorable tolerance situation.

The receptacle 11 has an opening 31, which is shown in FIG. 4 and through which the operating fluid tank 6 can be introduced into the receptacle 11 or can be removed in the removing direction 18. The ribs 13 extend in this case transversely, in particular perpendicularly to the plane 41 of the opening 31. The plane 41 of the opening 31 is schematically indicated in FIG. 7. The plane 41 of the opening 31 extends perpendicularly to the removing direction 18 and is that plane of the opening 31 that is farthest away from the base 12 of the receptacle 11. The plane 41 of the opening 31 of the receptacle 11 coincides in the embodiment with the plane in which the end side 17 of the outer wall 7 is located, and is at the spacing (b) from the end sides of the ribs 31.

Figure 8:
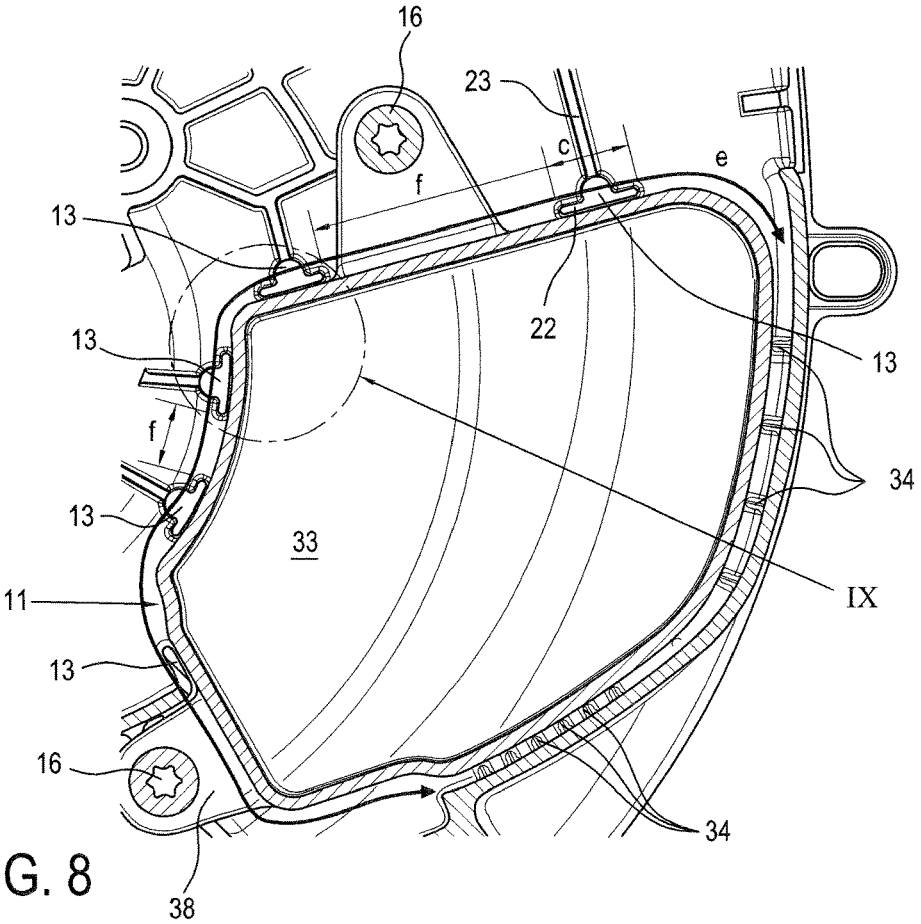
FIG. 8 shows a sectional detail illustration along the line VIII-VIII in FIG. 7; and, FIG. 9 shows the detail IX from FIG. 8 in an enlarged illustration.
Figure 9:
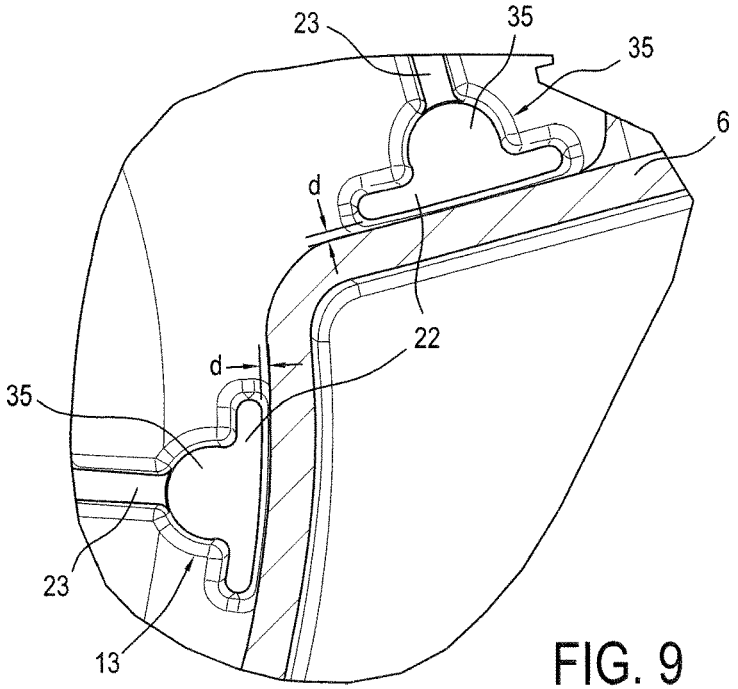

FIGS. 8 and 9 show the arrangement of the operating fluid tank 6 in the receptacle 11 in detail. FIG. 8 also shows the two fastening screws 16 of the operating fluid tank 6. As FIG. 8 shows, the ribs 13 have a width (c) measured in the circumferential direction of the operating fluid tank 6, that is, in a plane perpendicular to the removing direction 18. The width (c) is in this case the extent of the ribs 13 parallel to the adjacent outer wall of the operating fluid tank 6. The width (c) is relatively small with regard to the circumferential range (e) of the operating fluid tank 6 in the region of the ribs 13. The circumferential range (e) in the region of the ribs 13 is part of the circumference, in which the operating fluid tank 13 is delimited exclusively by ribs 13 and not by the outer wall 7 and/or by supporting studs 34. The sum of the widths (c) of all the ribs 13 is advantageously less than 50% of the circumferential range (e), in particular less than 30% of the circumferential range (e). Preferably, the sum of the widths (c) is less than 20%, in particular less than 10% of the circumferential range (e). In the embodiment, five ribs 13 are provided. Adjacent ribs 13 are at a spacing (f) from one another. The spacing (f) of adjacent ribs 13 from one another does not have to be the same for all the ribs 13. In the embodiment, different spacings (f) between adjacent ribs 13 are provided. The spacing (f) is advantageously at least half the width (c). Preferably, the spacing (f) is at least 80% of the width (c). In particular, at least one spacing (f) between adjacent ribs 13 is larger than the width (c) of the adjacent ribs 13.

As FIG. 9 shows, in normal operation and in an unloaded state of the blower apparatus 1, the ribs 13 do not bear against the wall of the operating fluid tank 6, but are at a spacing (d) from the wall of the operating fluid tank 6. The spacing (d) is advantageously from 0.1 mm to 5 mm. As a result, in the event of forces acting on the operating fluid tank 6 from the outside, the operating fluid tank 6 can initially move inside the receptacle 11. The forces that occur are absorbed only by the fastening domes 39. During the movement of the operating fluid tank 6, the fastening domes and/or the tabs 38 are elastically deformed. After a deformation of the fastening domes 39 that is predefined by the spacing (d) of the ribs 13 from the operating fluid tank 6, the operating fluid tank 6 comes to rest against the ribs 13, which effect additional support and absorption of the forces acting on the operating fluid tank 6. As a result, excessive loading of the tabs 38 and of the fastening domes 39 is also avoided.

As FIG. 9 shows, the ribs 13 are each provided with a thickening 35 in the region of the connection of the delimiting region 22 to the supporting region 23. The thickening 35 likewise leads to an increase in the stability of the ribs 13.

A cavity 33, which is formed in the interior of the operating fluid tank 6, is also discernible in FIG. 8. The cavity 33 is delimited by the two portions 8 and 9 of the operating fluid tank. The cavity 33 serves to receive operating fluid, in the embodiment fuel. The operating fluid tank 6 can also serve to receive oil or other operating liquids, however. Advantageously, the operating fluid tank 6 and the housing part 2 are made of different materials, preferably of different plastics materials. On account of the fastening of the operating fluid tank 6 via fastening screws 16, the structural configuration is independent of the type of plastics material selected. Instead of fastening screws 16, it is also possible to use other fasteners, for example rivets, snap-fits or the like. The fastening point, for example a snap-fit, is in this case formed in particular integrally on a rib 13. An additional fastening dome 39 can be dispensed with as a result. Fastening using adhesive as the fastener can also be advantageous. Advantageously, a form- and/or force-fitting connection is produced by way of the fastener. As a result, the operating fluid tank 6 can be removed nondestructively from the housing part 2. Simple replacement of the operating fluid tank 6 is possible.

As FIG. 8 shows, the spacing (f) between adjacent ribs is measured in a section plane perpendicular to the removing direction 18. In the embodiment, the ribs 13 extend parallel to the removing direction 18 and are at the spacing (f) from one another in every section plane perpendicular to the removing direction 18. In the embodiment, the portions 8 and 9 butt against one another on that side of the portion 8 that extends at the rim 10, such that the portions 8 and 9 coincide with the two half-shells from which the operating fluid tank 6 is composed, apart from the portion 10*a* of the rim 10. However, provision can also be made for the portions 8 and 9 not to correspond to the half-shells from which the operating fluid tank is manufactured. The operating fluid tank 6 can also be produced in one piece, for example as a blow-molded part.

It is understood that the foregoing description is that of the preferred embodiments of the invention and that various changes and modifications may be made thereto without departing from the spirit and scope of the invention as defined in the appended claims.

What is claimed is:

1. A portable work apparatus comprising:
a drive motor;
a housing part;
a housing at least partially formed by said housing part;
an operating fluid tank formed separately from said housing part;
said operating fluid tank defining a cavity configured to accommodate operating fluid;
said housing part including a receptacle;
said operating fluid tank having a first section arranged in said receptacle of said housing part;
said operating fluid tank further having a second section projecting out of said receptacle and at least partially delimiting said cavity;
at least one fastener configured to fix said operating fluid tank to said housing part;
said housing part having a plurality of ribs mutually arranged at a distance (f) to each other;
said plurality of ribs each having a delimiting region facing said operating fluid tank and delimiting said receptacle;
said operating fluid tank defining a circumference;
said plurality of ribs including at least one rib wherein said delimiting region of said at least one rib is disposed at a distance (d) to said operating fluid tank and extends approximately parallel to said circumference of said operating fluid tank in a region of said operating fluid tank to which said distance (d) is measured; and,
said distance (d) lying in a range of 0.1 mm to 5 mm.

2. The portable work apparatus of claim 1, wherein said second section includes a filler neck.

3. The portable work apparatus of claim 1, wherein:
said operating fluid tank defines a circumferential direction and a circumferential range (e);
each of said ribs has an individual measured width (c); and,
the sum of said individual measured widths (c) is less than 50% of said circumferential range (e).

4. The portable work apparatus of claim 1, wherein:
said at least one rib further has a support region transverse to said delimiting region and oriented away from said receptacle.

5. The portable work apparatus of claim 1, wherein:
said operating fluid tank has an outwardly protruding edge; and,
said first section and said second section are interconnected at said outwardly protruding edge.

6. The portable work apparatus of claim 5, wherein:
said housing part has at least one wall forming an outer wall of the portable work apparatus;
said outer wall has an end face and at least partially delimits said receptacle; and,
said outwardly protruding edge is configured to rest against said end face.

7. The portable work apparatus of claim 1, wherein said operating fluid tank and said housing part are made of different plastic materials.

8. The portable work apparatus of claim 1, further comprising:
a fan wheel;
a blower scroll;
a blower tube;
the portable work apparatus being a blower;
said drive motor being configured to drive said fan wheel so as to convey a blower air flow through said blower tube;
said housing part being configured as a blower housing; and,
said blower housing at least partially delimiting said blower scroll.

9. The portable work apparatus of claim 8, wherein:
said receptacle has a base;
said housing part includes a wall delimiting said base; and,
said wall at least partially delimits said blower scroll.

10. The portable work apparatus of claim 1, wherein said at least one rib is configured such that if large forces act on said operating fluid tank, said operating fluid tank can yield in a direction of said delimiting region and overcome said distance (d) and can come to rest against said delimiting region of said at least one rib causing said at least one rib to flex elastically.

11. A portable work apparatus comprising:
a drive motor;
a housing part;
a housing at least partially formed by said housing part;
an operating fluid tank formed separately from said housing part;
said operating fluid tank defining a cavity configured to accommodate operating fluid;
said housing part including a receptacle;

said operating fluid tank having a first section arranged in said receptacle of said housing part;

said operating fluid tank further having a second section projecting out of said receptacle and at least partially delimiting said cavity;

at least one fastener configured to fix said operating fluid tank to said housing part;

said housing part having a plurality of ribs mutually arranged at a distance (f) to each other;

said plurality of ribs each having a delimiting region facing said operating fluid tank and delimiting said receptacle;

said receptacle defining an opening and having a base;

said fastener being configured to be releasable; and, said first section of said operating fluid tank being configured to be removable in a removal direction through said opening when said fastener is released;

said plurality of ribs extending from said base in the removal direction, wherein a greatest extent of said ribs is aligned in the removal direction;

said operating fluid tank defining a circumferential direction;

said delimiting regions of said plurality of ribs being parallel to the removal direction and approximately parallel to the circumferential direction of said operating fluid tank so as to cause the corresponding one of said delimiting regions of each of said plurality of ribs to form a surface adjoining said receptacle.

12. The portable work apparatus of claim 11, wherein:

at least one rib is at a distance (d) to said operating fluid tank measured perpendicular to said removal direction; and, said distance (d) lies in a range of 0.1 mm to 5 mm.

13. The portable work apparatus of claim 11, wherein said at least one fastener fixes said operating fluid tank in a play-free manner in said removal direction.

14. The portable work apparatus of claim 11, wherein:

at least one rib of said plurality of ribs is at a distance (d) to said operating fluid tank measured perpendicular to said removal direction; and, said at least one rib is configured such that if large forces act on said operating fluid tank, said operating fluid tank can yield in a direction of said delimiting region and come to rest against said delimiting region of said at least one rib causing said at least one rib to flex elastically.

15. A portable work apparatus comprising:

a drive motor;

a housing part;

a housing at least partially formed by said housing part;

an operating fluid tank formed separately from said housing part;

said operating fluid tank defining a cavity configured to accommodate operating fluid;

said housing part including a receptacle;

said operating fluid tank defining a circumference and having a first section arranged in said receptacle of said housing part;

said operating fluid tank further having a second section projecting out of said receptacle and at least partially delimiting said cavity;

at least one fastener configured to fix said operating fluid tank to said housing part;

said housing part having a plurality of ribs mutually arranged at a distance (f) to each other;

said plurality of ribs at least partially delimiting said receptacle;

each of said plurality of ribs having a rib cross-section; and, each of said rib cross-sections being an L-shaped cross-section or a T-shaped cross-section as a result of which each of said cross-sections has a widened region, wherein said widened region faces said operating fluid tank and delimits said receptacle over a section of said circumference of said operating fluid tank.

* * * * *